US005237907A

United States Patent [19]

Pöschl

[11] Patent Number: 5,237,907

[45] Date of Patent: Aug. 24, 1993

[54] RADIAL PISTON MACHINE HAVING WORKING FLUID PASSING THROUGH THE CRANKCASE

[75] Inventor: Günter Pöschl, Schwaikheim, Austria

[73] Assignee: PPV Verwaltungs-AG, Zürich, Switzerland

[21] Appl. No.: 449,902

[22] PCT Filed: Apr. 26, 1989

[86] PCT No.: PCT/EP89/00459
§ 371 Date: Dec. 26, 1989
§ 102(e) Date: Dec. 26, 1989

[87] PCT Pub. No.: WO89/10468
PCT Pub. Date: Nov. 2, 1989

[30] Foreign Application Priority Data

Apr. 27, 1988 [DE] Fed. Rep. of Germany ..... 3814269

[51] Int. Cl.[5] ..... F01B 1/08; F01B 13/06; F04B 27/04; F04B 1/06

[52] U.S. Cl. ..... 91/491

[58] Field of Search ..... 91/491

[56] References Cited

U.S. PATENT DOCUMENTS

| | | | |
|---|---|---|---|
| 470,978 | 3/1892 | Bruce | 91/491 |
| 2,366,186 | 1/1945 | Freeman . | |
| 2,683,422 | 7/1954 | Richards . | |
| 3,991,728 | 11/1976 | Vittert . | |
| 4,772,184 | 9/1988 | Laing et al. | 417/568 |
| 4,792,289 | 12/1988 | Nieratschker | 417/901 |

FOREIGN PATENT DOCUMENTS

| | | | |
|---|---|---|---|
| 257122 | 3/1988 | European Pat. Off. . | |
| 1653436 | 5/1971 | Fed. Rep. of Germany . | |
| 2515229 | 11/1975 | Fed. Rep. of Germany . | |
| 2744591 | 4/1979 | Fed. Rep. of Germany . | |
| 3709389 | 10/1987 | Fed. Rep. of Germany . | |
| 61-207801 | 9/1986 | Japan . | |
| 08074 | 10/1988 | World Int. Prop. O. | 91/491 |

*Primary Examiner*—Leonard E. Smith
*Attorney, Agent, or Firm*—William H. Eilberg

[57] ABSTRACT

A piston machine (10) has two pistons (42, 44) which are reciprocatable in two cylinders (20, 22) and which, in the first and second working chambers (50, 52) thereof, can be subjected to a working medium. The pistons are connected to a crankshaft (30) via two connecting rods (38, 40) which are pivotally connected to one and the same crank pin (36). The interior of the crankcase (18) forms a third working chamber (54). The crankshaft (30) is formed as a rotary slide valve which in operation of the piston machine (10) connects the first working chamber (50) to the third working chamber (54) and the second working chamber (52) to a working medium supply or discharge opening (14, 16). The piston machine can be used selectively as an engine (e.g. as an expansion motor operated with compressed gas) or as a working machine (e.g. as a compressor). The opening and closing times can be controlled exactly. For generating the same power, less working medium is required than in the prior art.

10 Claims, 7 Drawing Sheets

RADIAL PISTON MACHINE HAVING WORKING FLUID PASSING THROUGH THE CRANKCASE

FIELD OF THE INVENTION

The invention relates to a piston machine.

BACKGROUND OF THE INVENTION

A known piston machine, in which the working medium can be conducted through the crankcase would for example be a 2-stroke radial engine. The starting point of the invention was not however the intention of providing an improved internal-combustion engine. The objective was rather to provide an improved working machine which can also be used as engine. A known representative of such a working machine is a reciprocating-piston compressor. It cannot however be operated as working machine without having to make extensive constructional modifications to the overall construction of the compressor. Furthermore, compressors usually operate with valve control. A valve control is prone to wear and due to the masses moved permits only limited speeds of rotation. Furthermore, all known working machines operating with valve control have a constructionally inherent dead space wherever valves or valve plates seal the piston working chamber and are always designed so that they simultaneously act as check valve. The dead or waste space gives poor efficiency because working medium compressed therein always remains in the working chamber, i.e. the latter is never completely emptied. Obviously, this reduces the efficiency.

Reciprocating-piston compressors, which today are used in refrigeration apparatuses, have the disadvantage that great damage is caused if liquid occurs in the refrigerant cycle which gets into, the compressor. Usually, the liquid action damages the valve plates. To avoid this disadvantage and further disadvantages the practice is now to use plate compressors, i.e. compressors operating only by the displacement principle. These also have however disadvantages, i.e. greater wear at the discs due to strong area pressure between discs and housing inner wall at the sealing points. Furthermore, swash-plate compressors have already been used but these have the disadvantage that high frictional losses occur therein and this also leads to poor efficiency.

All rotary piston working machines operating by the displacement principle can also be operated as engines. It is for example known to cause disc compressors to operate as disc motors (e.g. in pneumatic tools as drive motors). However, the disadvantages which such machines have as working machines are still present in them as engines or prime movers. Moreover, such engines have a very high consumption of working medium and for this reason also poor efficiency.

Finally, known piston machines have poor size/-power ratios.

SUMMARY OF THE INVENTION

The problem underlying the invention is to considerably improve the efficiency of a piston machine with simpler construction and compacter overall size as well as greatly reduced working medium consumption.

This problem is solved by the invention.

In the piston machine according to the invention the interior of the crankcase is used as third working chamber. The working medium which has been compressed or expanded in one of the two piston working chambers can therefore additionally do work in the third working chamber. In the third working chamber an oscillating working medium column forms which presses against both piston inner sides and at the piston connected to the one working medium opening generates pressure which in conventional piston machines does not occur at this point. The connecting rod system, which consists of the two connecting rods and which bends and extends at its articulation point to the crank pin, generates the oscillating working medium column and permits the aforementioned utilization of the additional pressure.

When the piston machine is operated as engine (i.e. for example as expansion motor operated with compressed gas) said additional pressure is added to the pressure generated in the working chamber of the other piston by expansion of the working medium. When the piston machine according to the invention is operated as working machine (for example as compressor) the working medium compressed in the working chamber of the first piston is subsequently conducted into the third working chamber where its pressure assists the one piston in the next compression stroke thereof and at the same time by the extension or stretching of the connnectingrod system supports the other piston in its induction stroke so that in this case the additional relieving by the pressure in the third working chamber leads to the desired improvement in the efficiency.

The slide valve means used in the piston machine to the invention is not directly associated with the first and second working chamber so that dead spaces are avoided in the latter. The opening and closing times can be controlled substantially more exactly than by means of the check valves used in the prior art because the latter valves can be caused to open by resonance vibrations.

The working medium consumption in the piston machine according to the invention is considerably less than in the prior art because for the same power less working medium is required since additional energy is drawn from the third working chamber. Since to produce the same power compared with the prior art less working medium is required the first and second working chambers can be made correspondingly smaller. This gives a substantially compacter overall size of the piston machine or engine according to the invention for the same power.

Advantageous further developments of the invention are set forth in the subsidiary claims.

In the further development of the invention the slide valve means has a very simple construction and nevertheless ensures a very exact control. The number of individual parts is small, not only because the crankshaft itself forms the rotary slide valve but also because only the crank pin and the two connecting rods with their pistons and piston pins are present as moving parts.

In the further development the piston machine forms an outer rotor. In this embodiment the piston machine runs very silently because the only moved masses it contains are the oscillating pistons. The revolving rotor has a large mass and accordingly stores a large amount of energy which assists the silent running of the piston machine.

In the further development of the invention the displaceable cylinder liners provide with their head portion a good low-wear sealing. If the pressure between the piston and stator exceeds a predetermined value, for example because on compressing a liquid is present, the cylinder liner can yield inwardly and thus contribute to the pressure relieving. If a known high-pressure compressor is stationary for a relatively long time then experience has shown that condensate forms in the working chamber of the piston which is at the lower deadcentre. On starting up the high-pressure compressor this almost always leads to the valve plates being broken (due to the aforementioned liquid shock). When the piston machine according to the invention is used as high-pressure compressor this danger is eliminated because the cylinder liners at the start Of the running up of the piston machine do not yet bear with high pressure on the inner wall of the stator and therefore readily allow condensate to escape into the third chamber which it leaves with the working medium.

The check valves provided in the further development of the invention are necessary only with some working media which tend to leak because of their low density. The control openings have a peripheral spacing which is equal to the arc length of the working chamber at the stator inner periphery. As a result a good sealing is achieved between the head portion of each cylinder liner and the housing need not perform any sealing function in the region outside the head portion.

In the further development of the invention the crescent-shaped intermediate chamber is provided as fourth working chamber (sub-divided by the head portion of the cylinder liner). Working medium compressed or made to expand in the first or second working chamber will ensure additional pressure or relief in the crescent-shaped intermediate chamber at the tangential working faces.

In the further development of the invention the rotational setting of the crankshaft can be achieved for example by means of the refrigerant pressure in a refrigeration apparatus in accordance with the power. With increasing working medium pressure, which acts on the rack, the position of the crank pin is changed so that for example the filling time increases. In this manner according to the invention the displacement of the piston machine used as refrigerant compressor can be adapted automatically to the refrigeration requirement.

In the further development of the piston machine the wear region thereof consists of ceramic.

If the piston machine thus designed according to the invention is used as engine it is extremely suitable as refrigerant compressor. For it does not need any oil lubrication. The advantages of the piston machine according to the invention that said machine is provided with a slide valve means instead of valves and, as explained above, does not have any dead space are further factors which make this machine ideally suitable for use as refrigerant compressor. The slide valve control does not have any reciprocating parts and is therefore considerably less prone to wear than valves; due to the avoidance of dead space the first and second working chambers can always be completely emptied and moreover the working medium in them can always be completely compressed.

When using the invention a piston machine assembly of any desired cylinder number can be achieved simply by connecting in series identical piston machines in a common housing with common crankshaft without having to modify the individual piston machines themselves. In this further development of the invention some of the piston machines may operate as working machines and the others as engines or alternatively they may all be operated as working machines or all as engines.

Several examples of embodiment of the invention will be described hereinafter with reference to the drawings, wherein:

DESCRIPTION OF THE PREFERRED EMBODIMENT

The piston machine illustrated in FIGS. 1 to 4, which can be used as compressor (i.e. working machine) or as expansion motor (i.e. engine) will be described in detail hereinafter with reference to use as compressor, followed by a brief explanation of its use as expansion motor.

Figure 1:
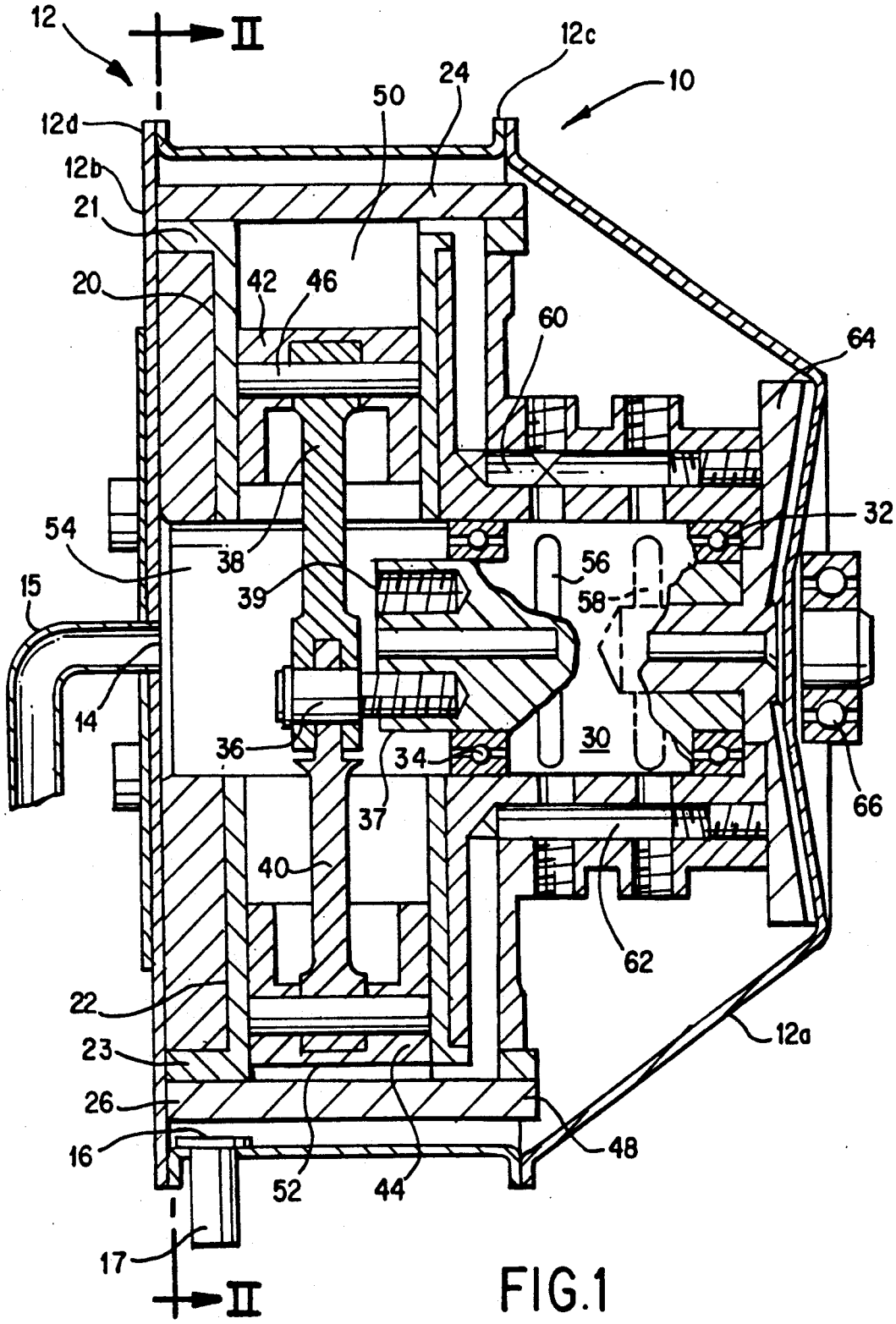
FIG. 1 is a longitudinal sectional view of a first embodiment of the piston machine according to the invention.
Figure 2:
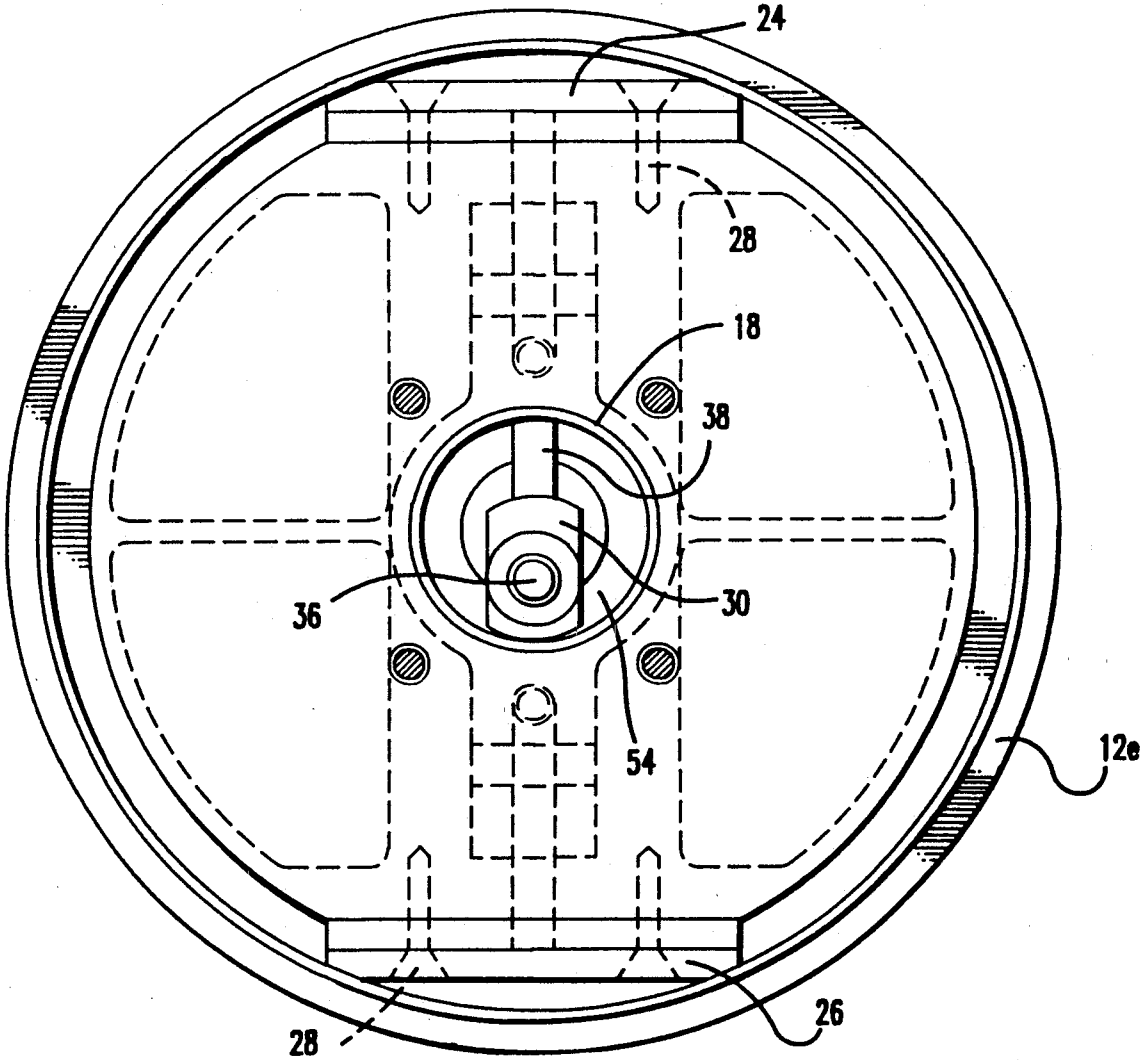
FIG. 2 is a cross-sectional view of the piston machine along the line II—II of FIG. 1.

FIGS. 1 and 2 show in longitudinal and cross-section a first embodiment of the piston machine which is denoted as a whole by the reference numeral 10. It comprises a ring housing 12 which is sealed by a frustoconical cover 12*a* and an annular cover 12*b* which are sealingly connected to the ring housing at flanges 12*c* and 12*d*. When used as refrigerant compressor this sealing connection is preferably established by hard soldering or welding. When using the piston machine as compressor for other purposes the sealing connection can also be established by means of screws and O rings (not illustrated). The ring housing 12 sealed by the covers 12*a*, 12*b* has only two working medium openings 14, 16 which are connected to working medium conduits 15 and 17 respectively.

The ring housing 12 contains a crankcase 18 on which two diametrically opposite cylinders 20, 22 are integrally formed. The cylinders each contain a cylinder liner 21 and 23 respectively. The two cylinders are each sealed on the outside by a plate 24, 26 respectively. In accordance with the illustration of FIG. 2 the plates 24, 26 are secured to the crankcase 18 by means of screws 28. It can further be seen in FIG. 2 that the crankcase 18 comprises an inner portion which is substantially cylindrical in cross-section and on which at the top and bottom the two cylinders 20 and 22 respectively are integrally formed. The outer ends of the cylinders are connected together by arcuate portions of the crankcase which are integrally connected by diametrically opposite ribs to the cylindrical inner portion as is shown in dashed line in FIG. 2.

According to the illustration in FIG. 1 the aforementioned portion of the crankcase, which is disposed substantially within the ring housing 12 is followed on the right by a hub-shaped portion which is disposed substantially within the frustoconical cover 12*a* and is likewise integrally formed on the rest of the crankcase 18. A crankshaft 30 is rotatably mounted by means of ball-bearings 32, 34 in said hub-shaped portion of the crankcase 18. At the left end in FIG. 1 the crankshaft 30 carries a crank pin 36 to which two connecting rods 38, 40 are pivotally connected at their inner ends.

Two pistons 42, 44 displaceably arranged in the cylinders 20, 22 are rotatably connected to the outer ends of the connecting rods 38, 40 by piston pins 46, 48. The connecting rods 38, 40 and the crank pin 36 are thus part of a crank drive which connects the pistons 42, 44 to the crankshaft 30. Between each end face of the pistons 42, 44 and each opposite plate 24 and 26 respectively a working chamber 50 and 52 is formed in which the working medium in the case of the compressor is compressed and in the case of the expansion motor is expanded. The space in the crankcase 18 between the crankshaft 30 and the cover 12*c* and between the inner sides of the pistons 42, 44 forms a third working chamber 54 which is connected to the working medium conduit 15.

In the piston machine according to FIGS. 1 and 2 the crankshaft 30 is formed as rotary slide valve which positively controls the flow of the working medium within the piston machine 10. For this purpose the crankshaft has two angularly offset control bores 56, 58. The control bore 56 leads from the third working chamber 54 to a passage 60 in the crankcase wall which is connected to the working chamber 50. The control bore 58 leads from a passage 62 in the crankcase wall which is connected to the working chamber 52 to the working medium opening 16. The mutual angular offsetting (in the direction of rotation of the crankshaft 30) is selected so that when the control bore 56 connects the working chamber 50 to the working chamber 54 the control bore 58 simultaneously or subsequently connects the working chamber 52 to the working medium opening 16.

The crank pin 36 is inserted into a blind bore 37 of the crankshaft 30. A diametrically opposite further blind bore 39 receives a balance weight, not illustrated. When the direction of rotation of the piston machine is to be reversed the crank pin 36 is inserted into the blind bore 39 and the balance weight into the blind bore 37. At the right end the crankshaft 30 carries an iron core 64 which is fixedly connected thereto and is part of a magnetic coupling which is otherwise not illustrated and is provided outside the outer housing 12. This part of the magnetic coupling which is not illustrated is mounted on a ballbearing 66 and is driven by an electric motor or the like which is also not illustrated. Consequently, when the magnetic coupling is energized the iron core 64 is entrained and the crankshaft 30 thus set in rotation. In this manner the compressor can be driven without shaft passages and the like being necessary. All the parts of the piston machine which slide on each other and generally all the wearing parts of the piston machine are coated with ceramic (e.g. oxide ceramic). The piston machine therefore requires no lubrication by conventional lubricants such as oil or the like.

When the piston machine according to FIGS. 1 and 2 is used as refrigerant compressor the refrigerant forming the working medium is sucked in via the working medium conduit 17. The refrigerant flows through the third working chamber 54, passes via the control bore 56 and passage 60 into the working chamber 50 and is compressed in the latter. Simultaneously, the second working chamber 52 is separated from the third working chamber 54 due to the angular offsetting of the control bore 58. The control bore 58 at this instant or later connects however the second working chamber 52 to the working medium opening 14 via which compressed refrigerant emerges. The connection between the control bore 58 and the working medium opening 16 is via the interior of the outer housing 12. As illustrated, the pistons 42, 44 are connected via the connecting rods 38 and 40 to the same eccentric crank pin 36 and consequently the one piston is at the top deadcentre when the other piston is at the bottom deadcentre and vice-versa. The refrigerant compressed in the working chamber 50 of the piston 42 subsequently passes to the third working chamber 54 where the refrigerant pressure assists the one piston in its next compression stroke and simultaneously assists the other piston in the induction stroke thereof by the stretching of the connecting-rod system consisting of the two connecting rods 38, 40.

When the piston machine 10 according to FIGS. 1 and 2 is operated as engine, i.e. as expansion motor operated with compressed gas, the latter passes via the working medium conduit 15 into the third working chamber 54, the pressure of the compressed gas thereby being added to the pressure in the working chamber of the other piston which is generated by expansion of the compressed gas in the working chamber. The piston machine can thus operate selectively as engine or working machine without any constructional modifications being necessary. In operation as expansion motor, via the pistons 42, 44 and the connecting rods 38, 40 the compressed gas drives the crankshaft 30 which via the iron core 64 and the other part of the magnetic coupling, not shown, drives the electric motor (likewise not shown), which then operates as generator. The simultaneous use of such piston engines as working machines and engines in a piston machine assembly will be described below with reference to FIG. 5.

Figure 3A:
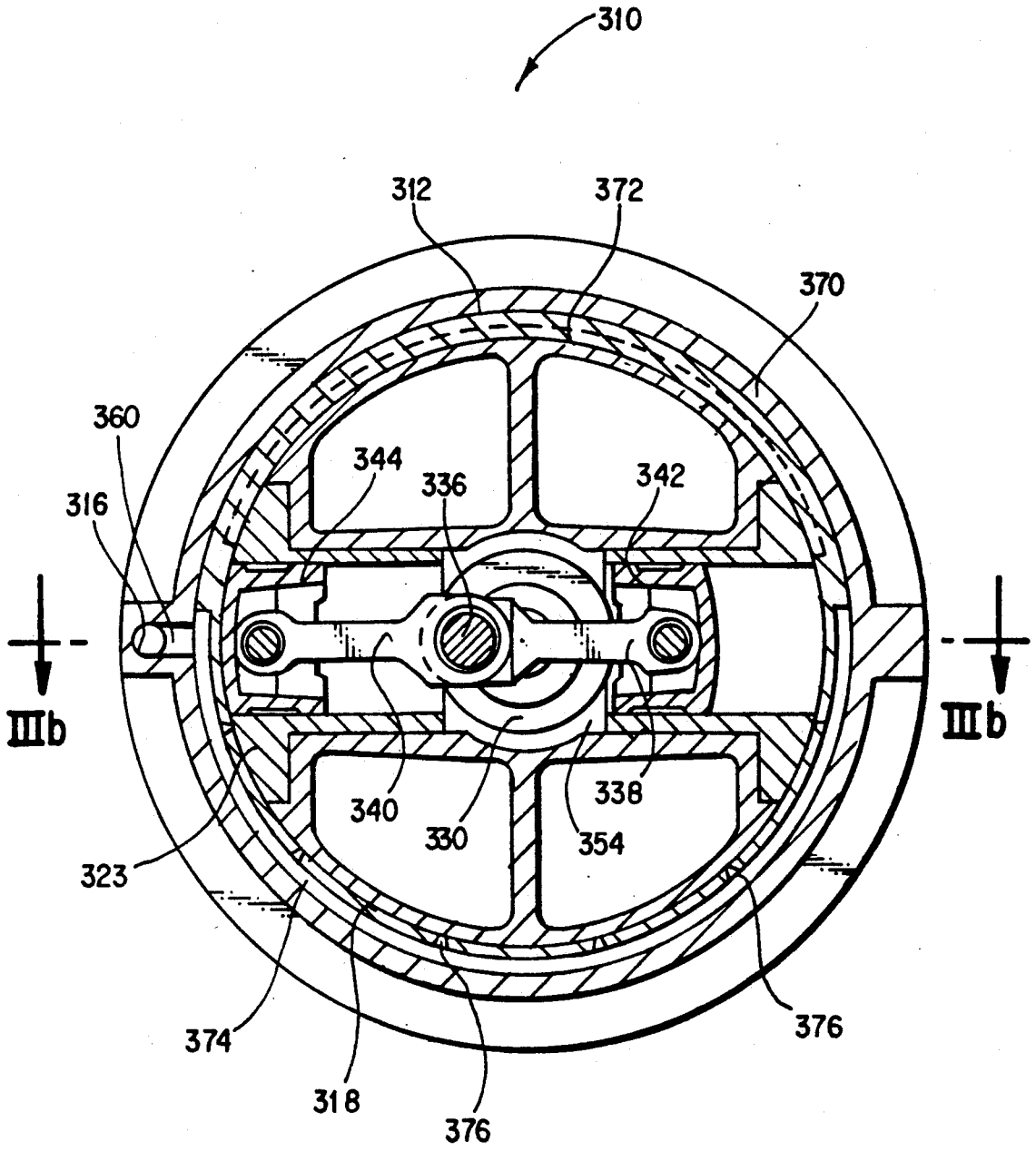
FIG. 3*a* is a cross-sectional view of a second embodiment of the piston machine according to the invention.
Figure 3B:
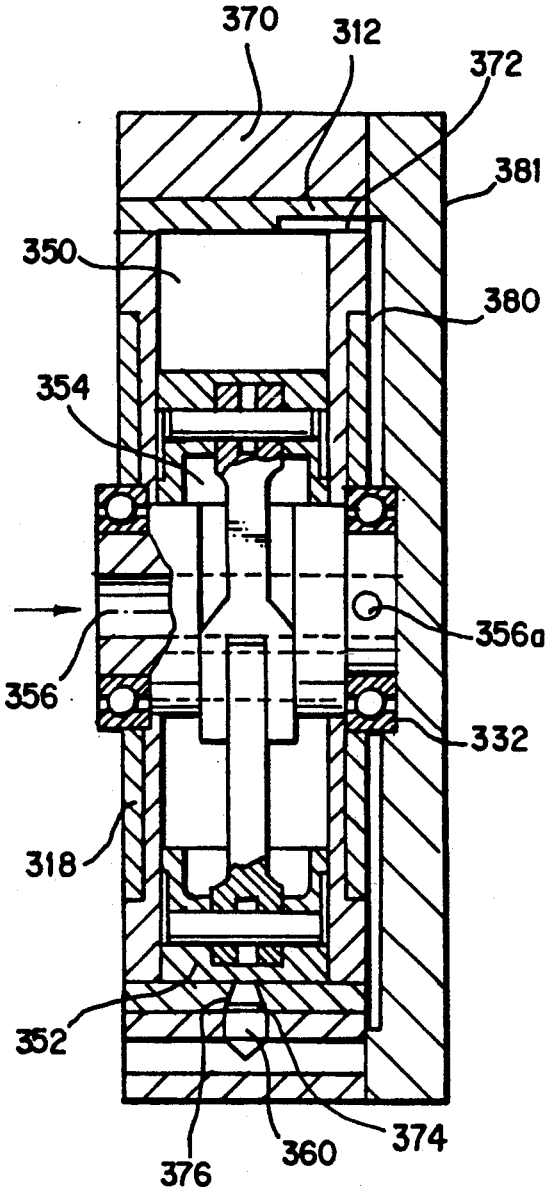
FIG. 3*b* is a longitudinal sectional view of the piston machine along the line IIIb—IIIb of FIG. 3*a*.
Figure 3C:
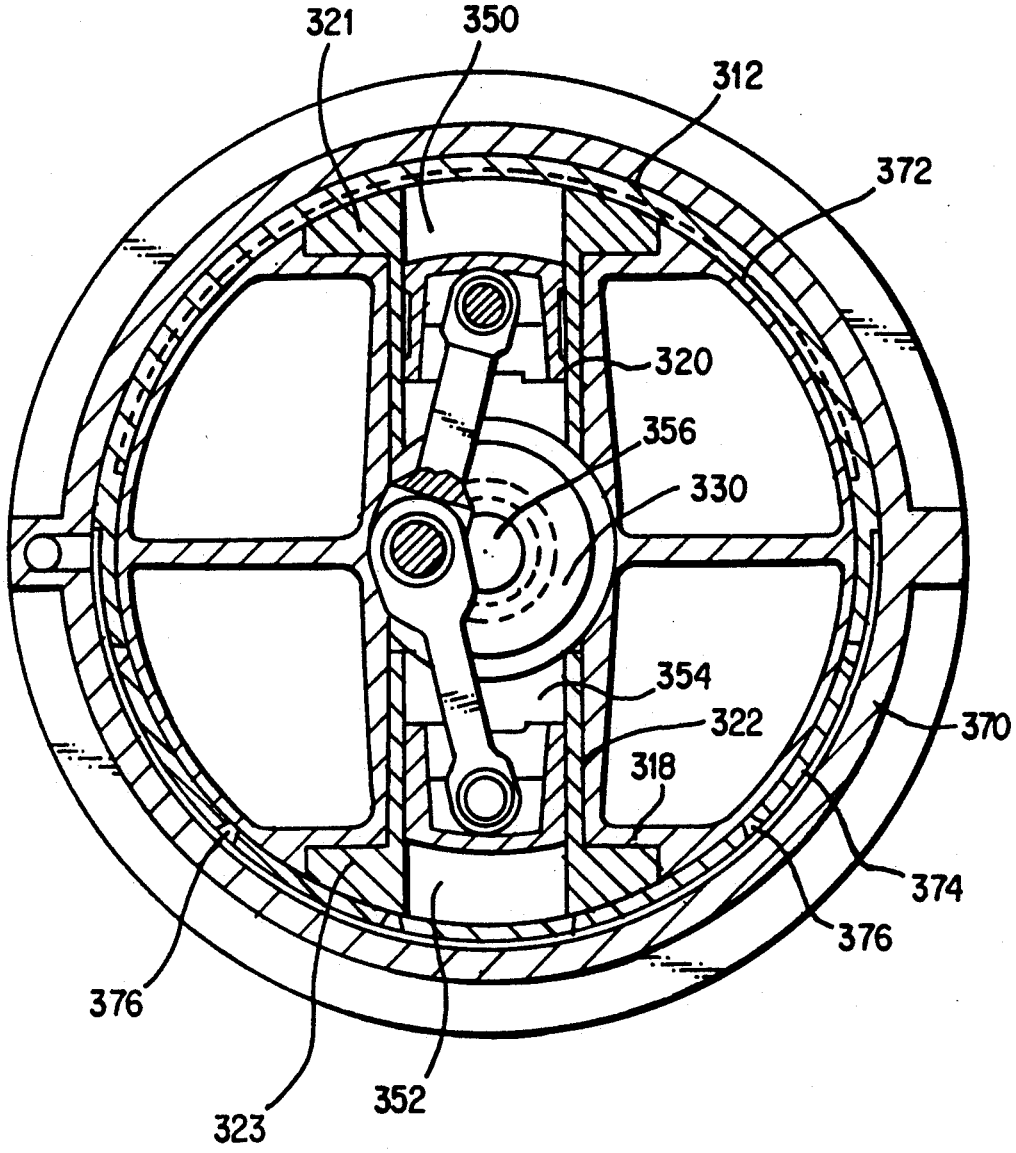
FIG. 3*c* shows the second embodiment of the piston machine according to the invention in a first position in which the crankcase is displaced through 90° with respect to the illustration of FIG. 3*a*.

In FIGS. 3*a*–3*c* identical parts to those in FIGS. 1 and 2 bear reference numerals each increased by 300. FIGS. 3*a*–3*c* show a second embodiment of the piston machine, denoted as a whole by 310, in which although the slide valve means is likewise a rotary slide valve the rotor of the rotary slide valve is formed by the crankcase 318, the stator of the rotary valve is the ring housing 312 and the crankshaft 330 is stationary. The cylinder liners 321 and 323 are made mushroom-shaped and arranged displaceably in the crankcase 318. The plates 24, 26 of the embodiment according to FIGS. 1 and 2 are not present in the embodiment according to FIGS. 3*a*–3*c*.

The head portions of the cylinder liners 321, 323 have on the inside parallel planar faces with which they can bear on adjacent shoulders of the crankcase 318 and external cylinder faces which have the same curvature as the inner wall of the ring housing 312. The cylinder liners 321, 323 are fitted with sliding fit into their cylinders 320 and 322 respectively so that when the crankcase 318 rotates they bear under centrifugal force against the inner wall of the ring housing 312 and seal the working chambers 350 and 352 respectively at the end faces. The ring housing 312 forming the stator is inserted into an outer housing 370 and as illustrated comprises two arcuate recesses 372, 374 on the inner and outer peripheries. The recess 372 at the inner periphery is connected to the second working chamber 354 via a gap 380 which is formed between a closure cover 381 and the crankcase 318. The crankshaft 330 has a bore 356 which communicates via a gap provided adjacent the ballbearing 332 with the gap 380. The bore 356 of the crankshaft opens at the right crank cheek via an opening 356*a* directly into the third working chamber 354. The arcuate recess 372 extends peripherally over an arc length of about 160° and axially from a point on the right of the centre plane of the section of FIG. 3*b* to the inner side of the closure cover 381.

The arcuate recess 374 at the outer periphery is an outer groove which extends peripherally over an arc length of about 180° and via control openings 376 formed in the ring housing 312 is in communication with the inner side of the ring housing 312. The mutual peripheral spacing of the control openings 376 is greater than or equal to the arc length of each working chamber 350, 352. On the other hand the recess 374 communicates with the working medium opening 316 in the outer housing 370 via a passage 360 formed as bore. The control openings 376 are provided with check valves 378 adapted to be pressed up from the inside to the outside.

In the embodiment according to FIGS. 3*a*–3*c* as well all the parts sliding on each other and generally all wearing parts are coated with ceramic (e.g. oxide ceramic) or made from ceramic.

When the piston machine according to FIGS. 3*a*–3*c* is used as refrigerant compressor the refrigerant forming the working medium is sucked into the third working chamber 354 via the bore 356 formed in the crankshaft 330 and the opening 356*a*. From the third working chamber 354 said refrigerant passes via the gap 380 and the annular recess 372 into the working chamber 350 in which it is compressed. Simultaneously, the second working chamber 352 is separated from the third working chamber 354 due to the mutual angular offsetting of the arcuate recesses 372, 374. At this instant or later the recess 374, via one of the control openings 376 connects the second working Chamber 352 to the working medium opening 316 via which compressed refrigerant emerges. In the embodiment according to FIGS. 3*a*–3*c* as well the pistons 342, 344 are connected as illustrated via the connecting rods 338 and 340 respectively to the same eccentric crank pin 336 and consequently the one piston is at the upper deadcentre when the other piston is at the lower deadcentre and viceversa. The refrigerant compressed in the working chamber 350 of the piston 342 thereafter passes into the third working chamber 354 where the refrigerant pressure supports the one piston in its next compression stroke and simultaneously by the extension of the connecting-rod system consisting of the two connecting rods 338, 340 assists the other piston in its induction stroke.

When the piston machine 310 according to FIGS. 3*a*–3*c* is operated as engine it works analogously to the piston machine according to FIGS. 1 and 2 and in this respect attention is drawn to the above description.

Figure 4:
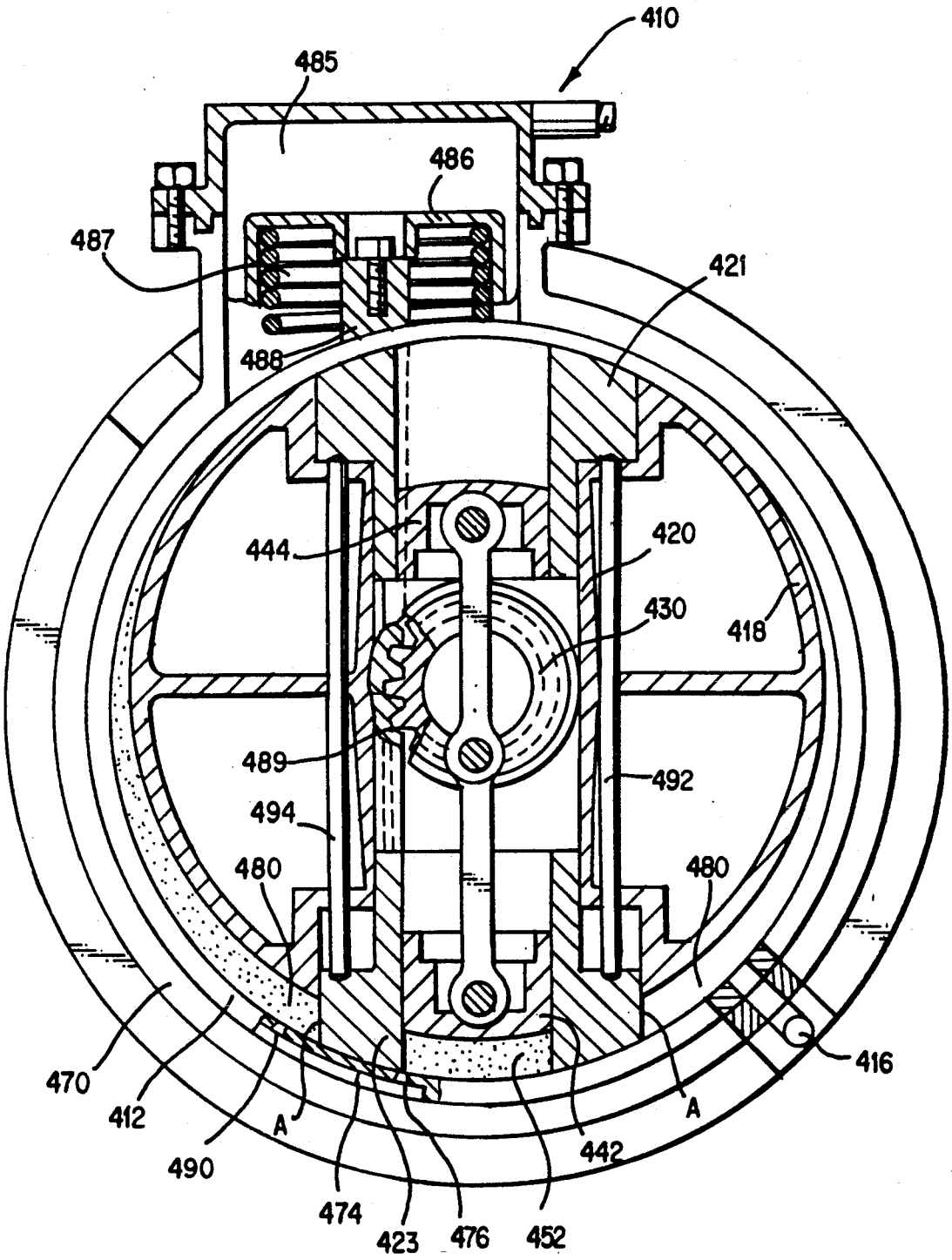
FIG. 4 is a cross-sectional view of a third embodiment of the piston machine according to the invention and FIG. 5 shows a piston machine assembly which comprises a plurality of piston machines according to FIG. 3 arranged in series with a common crankshaft.

The third embodiment of the piston machine, which is illustrated in FIG. 4 and denoted as a whole by 410, has fundamentally the same construction as the second embodiment according to FIGS. 3*a*–3*c* (for clarity, of the two arcuate recesses only the recess 474 has been shown in FIG. 4). Consequently, only the significant differences will be described, identical parts bearing reference numerals as in FIGS. 3*a*–3*c* increased by 100.

The crankcase 418 has a smaller diameter than the ring housing 412. The crankshaft 430 is eccentrically mounted so that a crescent-shaped intermediate space 480 is formed between the ring housing 412 (stator) and the crankcase 418 (rotor). The head portions of the cylinder liners 421, 423 have working surfaces A. In the position of the crankcase 418 illustrated in FIG. 4 the crescent-shaped intermediate space 480 is divided exactly into halves by the head of the cylinder liner 423 so that the one working area A confines the one half and the other working area A the other half of the intermediate space 480.

The outer housing 470 includes at the top a chamber 485 in which a rolling diaphragm piston 486 is mounted as illustrated. The space above the rolling diaphragm piston 486 is a pressure chamber which when the piston machine is used as refrigeration compressor is subjected to refrigerant pressure. A helical spring 487 disposed beneath the rolling diaphragm piston 486 acts against said pressure. The cylinder liners 421 and 423 are rigidly connected together by rods 492, 494 and thus only jointly displaceable in the cylinder 420. A piston rod 488 of the rolling diaphragm piston 486 is formed as rack which meshes with a pinion 489 non-rotatably connected to the crankshaft 430. The rack is actuable by subjecting the rolling diaphragm piston 486 to the refrigerant pressure in the chamber 485. In this manner the crankshaft 430 is rotationally adjustable.

The piston machine is shown in FIG. 4 in the centre position which applies for normal pressure. When the refrigerant pressure in the chamber 485 increases the crankshaft 430 is turned and the control time thus changed so that the working chamber over one of the two pistons 442, 444, into which working medium is sucked, is no longer completely filled. As a result the displacement drops accordingly. As a result the refrigerant pressure in the chamber 485 in turn drops so that the crankshaft is again turned in the direction of its position (illustrated) applying to normal pressure. With a pressure dropping in the chamber 485 compared with this position the converse process takes place.

In the piston engine according to FIG. 4 the crescent-shaped intermediate space 480 serves as fourth working chamber, in each case only one of the two parts of the intermediate chamber which face the working faces A. An overflow bore 490 which is formed in the ring housing 412 at the point illustrated in FIG. 4 communicates via the arcuate recess 474 at the outer periphery of the ring housing 412 with the working chamber 452 through one of the control openings 476. When the cylinder lining 423 has reached its position shown in FIG. 4 the refrigerant compressed in the working chamber 452 passes along the path described above into the part of the intermediate space 480 on the left in FIG. 4. In this case the crankcase turns anticlockwise in FIG. 4. The compressed refrigerant gas now expands in this part of the intermediate space 480 and drives the cylinder liner 423 additionally by acting on the left working area A thereof until the working chamber 452 comes into connection with the working medium 416 which leads outwardly and via which said part of the crescent-shaped intermediate space 480 is then evacuated. The head of the cylinder liner 421 assists the expulsion of the refrigerant via the working medium opening 416.

Figure 5:
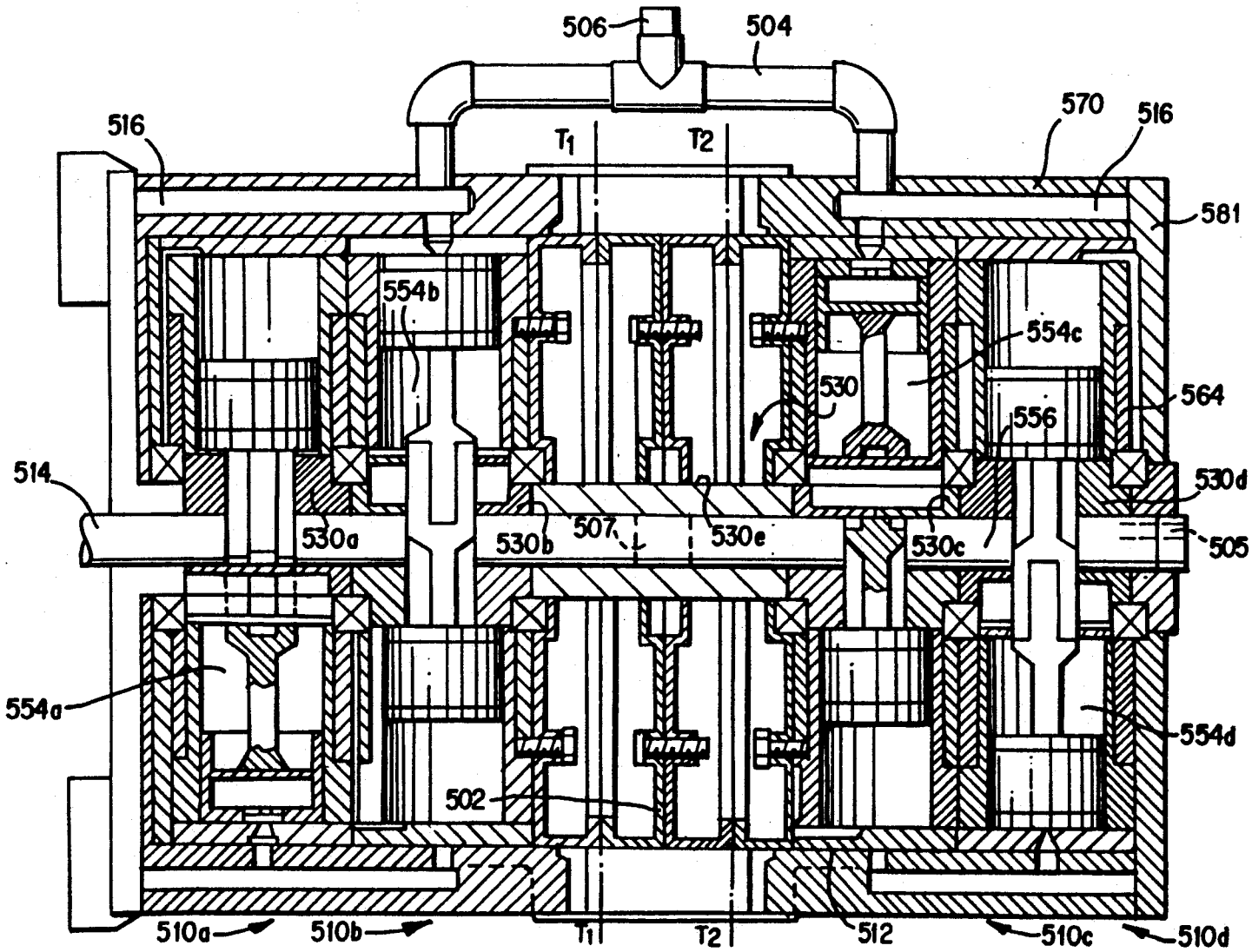

FIG. 5 shows the use of four piston machines 510*a*–510*d* in a common outer housing 570 and having a common crankshaft 530.

The crankshaft 530 consists of segments 530*a*–530*e* which are screwed together. Between the piston machine pair 510*a*, 510*b* on the one hand and the piston machine pair 510*c*, 510*d* on the other hand a magnetic coupling 502 is disposed. The piston machines 510*a*–510*d* have the same construction as the piston machine 310 according to FIGS. 3*a*–3*c*. The piston machine pair 510*a*, 510*b* acts on the same working medium 516. The same applies to the piston machine pair 510*c*, 510*d*. The working medium opening 516 of the one pair is connected to that of the other pair via an overflow line 504 and both the working medium openings 516 are formed as ring passages passing peripherally through the outer housing 570. The third working chambers 554*a*–554*d* of the piston machines are connected together via a bore 556 passing through the crankshaft 530 over its entire length. At the left end the bore 556 is connected to the working medium opening 514 and at the other end it is sealed by a plug 505. The magnetic coupling 502 has two separating planes T1, T2 indicated in dot-dash line. When the magnetic coupling is not energized the left and the right piston machine pair can be operated independently from each other, each as expansion motor or compressor. When the left piston machine pair operates as expansion motor the right piston machine pair can be selectively connected by energizing the magnetic coupling. The same applies when the left piston machine pair operated as compressor, when the right piston machine pair can be connected as further compressor. The overflow line 504 is connected to a manifold line via a connection 506. When all the piston machines are operating as compressor working medium is sucked in via the working medium opening 514 and compressed working medium discharged via the connection 506. When all the piston machines are working as expansion motor compressed gas is supplied via the connection 506 and then emerges via the working medium opening 514.

When the one piston machine pair is operated as expansion motor and the other piston machine pair as compressor the overflow line 504 is blocked (e.g. by a slide valve, not shown). Likewise, the bore 556 in the crankshaft 530 is blocked in the region between the two separating planes T1 and T2 (e.g. by a plug 507 indicated in dashed line). The two piston machine pairs then operate independently of each other in the manner described above with reference to FIGS. 3*a*–3*c*.

If for example the right piston machine pair 510*c*, 510*d* is operated as working machine, i.e. as compressor, besides the closure cover 591 as in the embodiment according to FIG. 1 a further magnetic coupling (not shown) is provided which is equipped with a rotary drive and through the closure cover 581 entrains an iron core 564 which is non-rotatably connected to the crankcase 518. In FIG. 5 for simplicity instead of a separate iron core 564 at least the right portion of the crankcase 518 is made from iron.

I claim:

1. Piston machine, capable of operating either as an engine (such as an expansion motor operated with compressed gas) or as a working machine (such as a compressor), the piston machine comprising:

two pistons connected via connecting rods to a single eccentric crank pin of a centrally located crankshaft, the pistons forming first and second working chambers in two cylinders, arranged 180° apart so that when one piston is at top deadcenter the other is at bottom deadcenter, said crank pin and connecting rod assembly being located in a crankcase, the machine further comprising a slide valve and control passages through which a working medium is conducted to and from the first and second working chambers, wherein the slide valve and control passages are so arranged that the working medium, at high pressure, passes through the crankcase regardless of whether the piston machine is operated as an engine or as a working machine, and wherein the crankcase acts as a third working chamber by virtue of the pressure from the working medium acting on the underside of the pistons.

2. The piston machine of claim 1, wherein the slide valve comprises a rotary slide valve.

3. The piston machine of claim 2, wherein the crankshaft itself forms the rotary slide valve.

4. The piston machine of claim 2, wherein the rotary slide valve comprises, as said control passages, two angularly offset control bores, one of which leads from the third working chamber to a first passage in the crankcase wall which is connected to the first working chamber, and the other of which leads from a second passage in the crankcase wall which is connected to the second working chamber to a working medium opening.

5. The piston machine of claim 1, wherein the slide valve is a rotary slide valve of which a rotor is formed by the crankcase and a stator is a ring housing, and that the crankshaft is stationary in operation.

6. The piston machine of claim 5, further comprising cylinder liners which are displaceably arranged in the crankcase and surround the first and second working chambers respectively and which for end-side sealing bear with their head portion on the inner wall of the ring housing.

7. The piston machine of claim 6, wherein the stator is inserted into an outer housing and comprises two arcuate recesses at the outer and inner periphery respectively, of which the one at the inner periphery is in communication with the third working chamber and the one at the outer periphery is in communication, on the one hand, via control openings, with the inner peripheral surface and, on the other hand, with a working medium opening.

8. The piston machine of claim 7, wherein the control openings are provided with check valves adapted to be pressed out from the inside to the outside.

9. The use of a plurality of piston machines are recited in claim 7, in a common outer housing and with a common crankshaft.

10. The piston machine of claim 1, wherein at least all the parts of the piston machine which slide on each other are coated with ceramic or made from ceramic.

* * * * *